United States Patent [19]

Reaume

[11] Patent Number: 4,663,876

[45] Date of Patent: May 12, 1987

[54] STOCK ASSEMBLY KIT AND RIFLE EMBODYING THE SAME

[76] Inventor: Robert N. Reaume, 16347 Windermere Cir., Southgate, Mich. 48195

[21] Appl. No.: 695,250

[22] Filed: Jan. 28, 1985

[51] Int. Cl.[4] ..... F41C 7/00; F41C 23/00; F41C 19/00

[52] U.S. Cl. ..... 42/71.01; 42/69.01; 42/72; 42/73; 42/75.01; 42/75.03

[58] Field of Search ..... 42/69 R, 71 R, 72, 73, 42/75.01, 75.03; 89/14.1

[56] References Cited

U.S. PATENT DOCUMENTS

| | | | |
|---|---|---|---|
| 201,524 | 3/1878 | Henry et al. | 42/69 R |
| 1,307,594 | 6/1919 | Newman | 42/72 |
| 2,467,372 | 4/1949 | Permentier | 89/14.1 |
| 2,674,822 | 4/1954 | Studler | 42/71 |
| 2,749,642 | 6/1956 | Saetter-Lassen | 42/75 |
| 3,075,314 | 1/1963 | Bakker | 42/71 |
| 3,323,246 | 6/1967 | Loffler | 42/75 |
| 3,388,494 | 6/1968 | Kimball | 42/73 |
| 3,512,290 | 5/1970 | La Violette et al. | 42/75 |
| 3,611,607 | 10/1971 | Donnell | 42/1 R |
| 3,623,257 | 11/1971 | Ray | 42/71 R |
| 3,999,461 | 12/1976 | Johnson et al. | 89/191 R |
| 4,242,826 | 1/1981 | Anschütz | 42/73 |
| 4,327,626 | 5/1982 | McQueen | 42/72 |
| 4,502,238 | 3/1985 | Farrar et al. | 42/73 |

*Primary Examiner*—Deborah L. Kyle
*Assistant Examiner*—Ted L. Parr
*Attorney, Agent, or Firm*—Barnes, Kisselle, Raisch, Choate, Whittemore & Hulbert

[57] ABSTRACT

A carbine comprising an improved stock assembly kit combined with a barrel and action assembly of preselected generic style or configuration, preferably that of a U.S. M1 carbine. The improved stock assembly includes a buttstock comprised of opposed concave half-sections which embrace and capture the trigger, receiver and operating slide mechanisms of the barrel and action assembly in upside-down orientation. A trigger assembly is mounted to the barrel forwardly of the buttstock section and is coupled to the trigger mechanism of the barrel and action assembly by a trigger slide which extends through the buttstock section. A forehand stock section is comprised of an opposed pair of stock half-sections which embrace that portion of the trigger assembly which engages the barrel and form a cavity for cooling air surrounding the barrel which extends therethrough. A concial flash hider is captured by the forehand stock sections surrounding the free end of the barrel and cooperates with apertures formed in the forehand stock sections for drawing cooling air into the cavity for cooling the barrel during firing.

22 Claims, 15 Drawing Figures

STOCK ASSEMBLY KIT AND RIFLE EMBODYING THE SAME

The present invention relates to rifle stocks, and more particularly to an improved stock assembly which may be provided in the form of a kit for use in conjunction with a rifle barrel and action assembly of preselected generic configuration, such as that of a U.S. M1 carbine.

A general object of the present invention is to provide an improved rifle stock which finds particular application in conjunction with the barrel and action assembly of a generic rifle configuration, particularly the U.S. M1 carbine, which when combined therewith is light in weight, which places the rifle action "on the shoulder" and thereby results in a shorter overall assembly, which is equally adapted for use by either right-handed or left-handed operators, which includes facility for accurate mounting of operators, which includes facility for accurate mounting of an optical scope sight and/or a carrying handle, which provides enhanced cooling of the carbine barrel during use, which is both functional and ornamental, and which may be readily disassembled for maintenance or repair.

The invention, together with additional objects, features and advantages thereof, will be best understood from the following description, the appended claims and the accompanying drawings in which:

Figures 2, 3, 4, 5, 6:
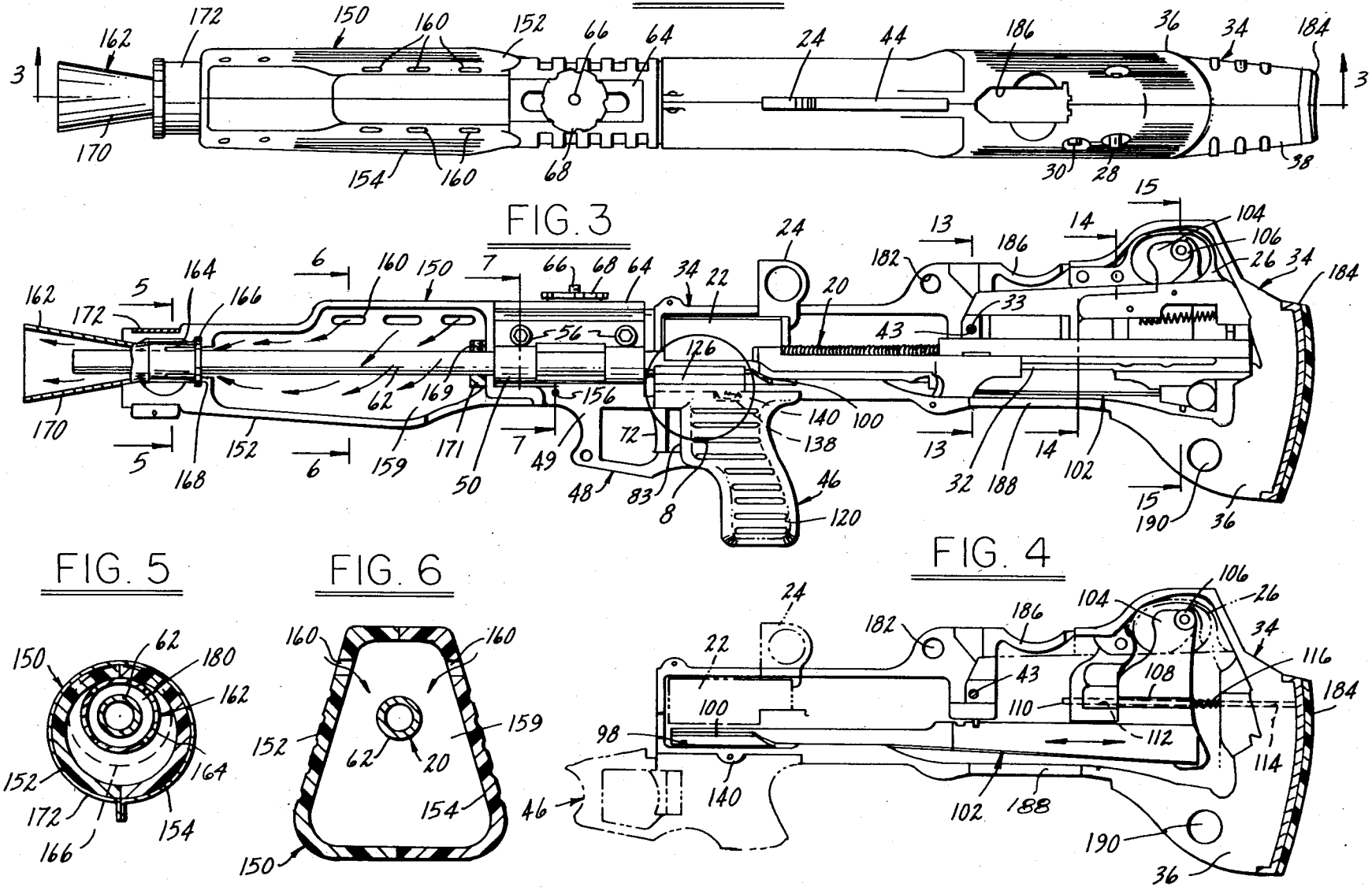
FIG. 2 is a top plan view of the carbine of FIG. 1 fully assembled.
FIG. 3 is a sectional view taken along the line 3—3 in FIG. 2.
FIG. 4 is a fragmentary sectional view of the buttstock portion of FIG. 3 with portions of the carbine barrel and action assembly shown in phantom.
FIGS. 5–7 are sectional views taken along the respective lines 5—5, 6—6 and 7—7 in FIG. 3.
Figure 8:
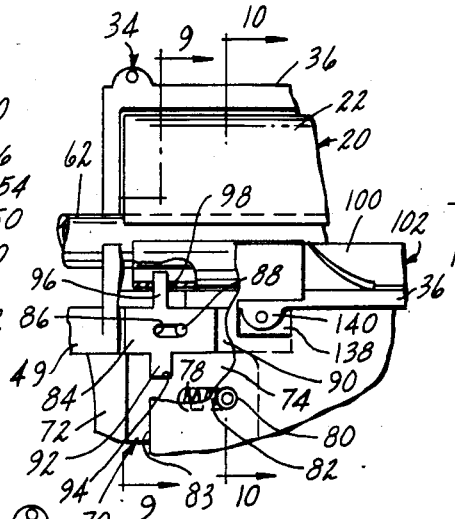
FIG. 8 is a fragmentary partially sectioned view on an enlarged scale of that portion of FIG. 3 contained within the circle 8.
Figure 9:
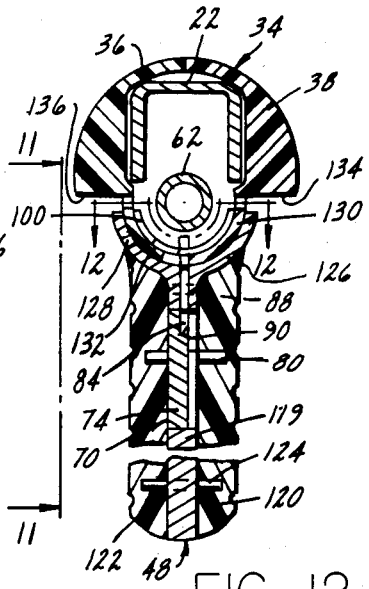
Figure 11:
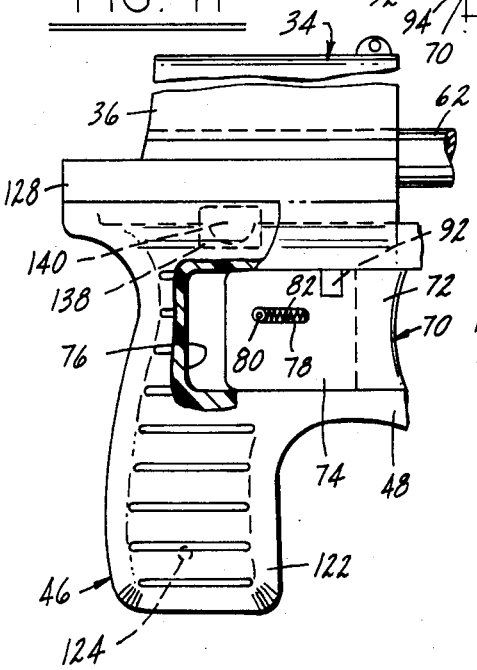
Figure 10:
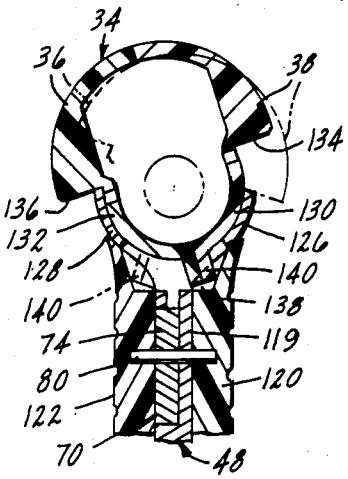
Figure 12:
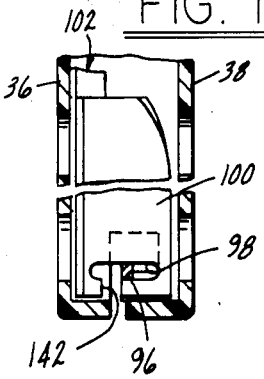
Figure 13:
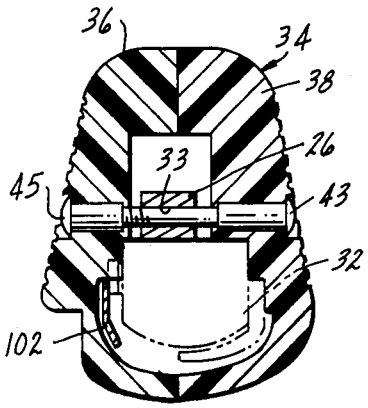
Figure 14:
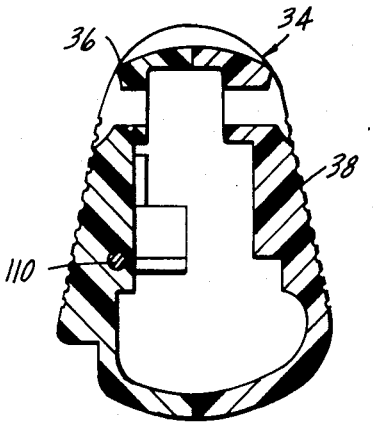
Figure 15:
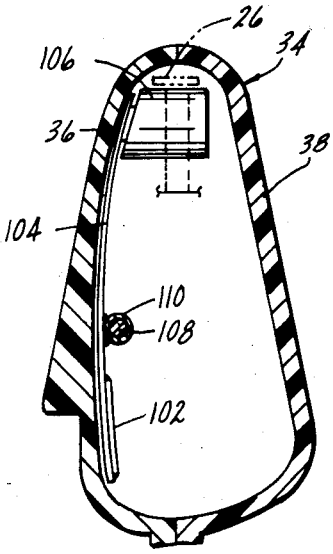

FIGS. 9 and 10 are fragmentary sectional views taken substantially along the respective lines 9—9 and 10—10 in FIG. 8;

FIG. 11 is a fragmentary elevational view substantially from a direction 11—11 in FIG. 9;

FIG. 12 is a fragmentary sectional view taken substantially along the line 12—12 in FIG. 9; and FIGS. 13–15 are sectional views taken substantially along the respective lines 13—13, 14—14 and 15—15 in FIG. 3.

The improved rifle stock assembly in accordance with the present invention is illustrated in the drawings and described in detail hereinafter in connection with a preferred embodiment thereof for use in combination with the barrel and action assembly of a standard U.S. cal. 30 M1 carbine. This embodiment of the invention is preferred because there are literally millions of M1 carbines available in the hands of collectors and enthusiasts. However, as will become apparent as the description unfolds, the principles of the invention may be applied equally as well to other generic rifle styles or configurations, such as the AR-15 civilian version of the military M-16. It will also be appreciated that directional adjectives, such as "forward" and "rearward", are employed in a descriptive sense in conjunction with conventional orientation of the rifle, with "rearward" being directed toward the butt section of the rifle and "forward" being directed toward the open barrel end. The terms "carbine" and "rifle" are employed somewhat interchangeably in the description. A "carbine" is a species of "rifle" having a short barrel length. Implementation of the invention is a "carbine" is preferred. However, it will become apparent as the description unfolds that the principles of the invention apply equally as well to other types of "rifles".

In general, the present invention contemplates an improved stock, which may be provided in the form of a kit for example, for use in conjunction with the barrel and action assembly of a generic rifle or carbine configuration, and the carbine or rifle which results from such a combination. The stock kit includes a pair of concave half-sections which are adapted to be assembled to each other in opposed relation so as to form a hollow buttstock section. The butt half-section cavities are internally contoured to snugly receive the action portion of a selected type of barrel and action assembly, i.e. the receiver, trigger and operating slide, with the action being located within the buttstock section internally adjacent to the shoulder abutment end thereof. A trigger housing assembly includes a trigger housing adapted to be firmly but rotatably clamped to the barrel of the barrel and action assembly immediately adjacent to the forward end of the buttstock section. A trigger is mounted in the trigger housing for sliding motion in a direction parallel to the barrel axis and is coupled to the trigger mechanism of the generic barrel and action assembly by a slide which extends through the buttstock section. The trigger housing includes a pistol-type grip and facility for mounting an optical scope sight and/or a carrying handle in accurate location with respect to the axis of the rotatably clamped barrel.

A pair of concave half-sections are adapted to be mounted in opposed relation to form a forehand stock section which encloses the barrel and that portion of the trigger housing assembly clamped thereto. The forehand stock half-sections include apertures for admitting cooling air into the volume or chamber which surrounds the barrel. An outwardly opening conical or funnel-shaped flash hider is captured by the forehand stock half-sections surrounding the trigger-remote or free end of the barrel. The flash hider and forehand stock half-sections are radially spaced from the free end of the barrel, which is to say that the free end of the barrel floats within and is not clamped by the stock. This not only provides enhanced firing accuracy but also promotes circulation of cooling air through the forehand stock section cavity by venturi action during firing of the rifle.

Turning now to the drawings in detail, the reference numeral 20 indicates a barrel and action assembly from a standard U.S. M1 carbine with buttstock, stock, handguard, front sight and recoil plate removed, and with relatively minor modification made thereto for use in conjunction with the stock assembly of the invention. Only such modifications will be described in detail. The laterally projecting handle (not shown) on the operating slide 22 is removed and replaced by an apertured tab or handle 24 which is affixed to the slide 22 and projects therefrom in the plane of the action trigger mechanism 26. The safety and magazine catches are removed and replaced by the safety and magazine catches 28,30, which are identical to those that they replaced but possess lengthened actuator buttons so as to extend through the walls of the buttstock section to be described. The trigger housing retaining pin, which couples trigger mechanism 26 to the magazine receiver mechanism 32 through the aperture 33, is likewise removed.

A buttstock section 34 comprises a pair of opposed generally concave buttstock half-sections 36,38 which are internally contoured so as to snugly receive and firmly clamp the action portion of barrel and action assembly 20, that is trigger and receiver mechanisms 26,32 and operating slide 22. Safety catch 28 projects through opposed aligned apertures 40 in the respective buttstock half-sections 36,38, and magazine release catch 30 projects through an aperture 42 in left-hand buttstock section 38. As best seen in FIG. 2, the upper edges of the concave buttstock sections are oppositely recessed or contoured along their upper edges so as to provide a slot 44 at the half-section parting line parallel to the barrel axis through which slide handle 24 projects and is slidable for operating slide 22. Slide 22 is, of course, slidable within section 34 for operating the rifle. Buttstock sections 36,38 are fastened to each other by the screw 43 and nut 45 (FIGS. 3 and 13) which extend through aperture 33.

A trigger housing assembly 46 includes a one-piece trigger housing 48 in the form of a flat plate 49 having a pair of axially aligned spaced integral semi-cylindrical bridges 50. Trigger housing plate 49 extends upwardly from bridges 50 and flares outwardly to form a planar platform 64 parallel to the axis of bridges 50. A bar 52 (FIGS. 1 and 7) is snugly clamped to plate 49 beneath platform 64 by the screws 56 which extend through openings 58 in plate 49 into internally threaded openings 60 in bar 52. Bar 52 has a pair of spaced coaxial arcuate tabs or ears 54 laterally aligned in assembly with bridges 50. Plate 49 and bar 52 are accurately formed so that bridges 50 and tabs 54 cooperate to snugly but not tightly clamp barrel 62 of barrel and action assembly 20 immediately forward of buttstock section 34. Trigger housing 48 is free to rotate about barrel 62 but is restrained from substantial lateral (radial) movement with respect thereto. A threaded stud 66 (FIGS. 1–3 and 7) projects upwardly from platform 64 and cooperates with a knurled jamnut 68 for fastening an optical scope sight (not shown) accurately with respect to the barrel axis, or for removably mounting a carrying handle (not shown) to the carbine.

A trigger 70 includes a head 72 having a concave forward edge configured to be engaged by a user's finger, and a generally rectangular rear body or shank 74 slidably disposed within a laterally opening rectangular pocket 76 on trigger housing plate 49 (FIG. 11). A longitudinal slot 78 (FIGS. 8 and 11) in trigger shank 74 is received over a pin 80 which projects through housing plate 49 and cooperates with the top and bottom edges of pocket 76 for guiding sliding motion of trigger 70 in a direction parallel to the barrel axis. Pin 80 cooperates with the coil spring 82 (FIGS. 8 and 11) in slot 78 so as to bias or urge trigger 70 to the forward position illustrated in the drawings. Trigger head 72 is enlarged laterally and cooperates with a flat edge 83 (FIGS. 1, 3 and 8) on plate 49 to form an abutment stop to rearward motion of trigger 70. A follower 84 (FIGS. 8, 9 and 12) has a central longitudinal slot 86 received over the pin 88 (FIGS. 1, 8 and 9) extending through trigger housing plate 49 for slidably guiding and capturing follower 84 in an upwardly opening central slot 90 (FIGS. 8 and 9) in the trigger housing plate. As best seen in FIG. 9, slot 90 is coplanar in assembly with the axis of barrel 62. A downwardly projecting tab or dog 92 on follower 84 is received within a corresponding upwardly opening notch 94 (FIGS. 8 and 11) on trigger shank 74.

Figure 1:
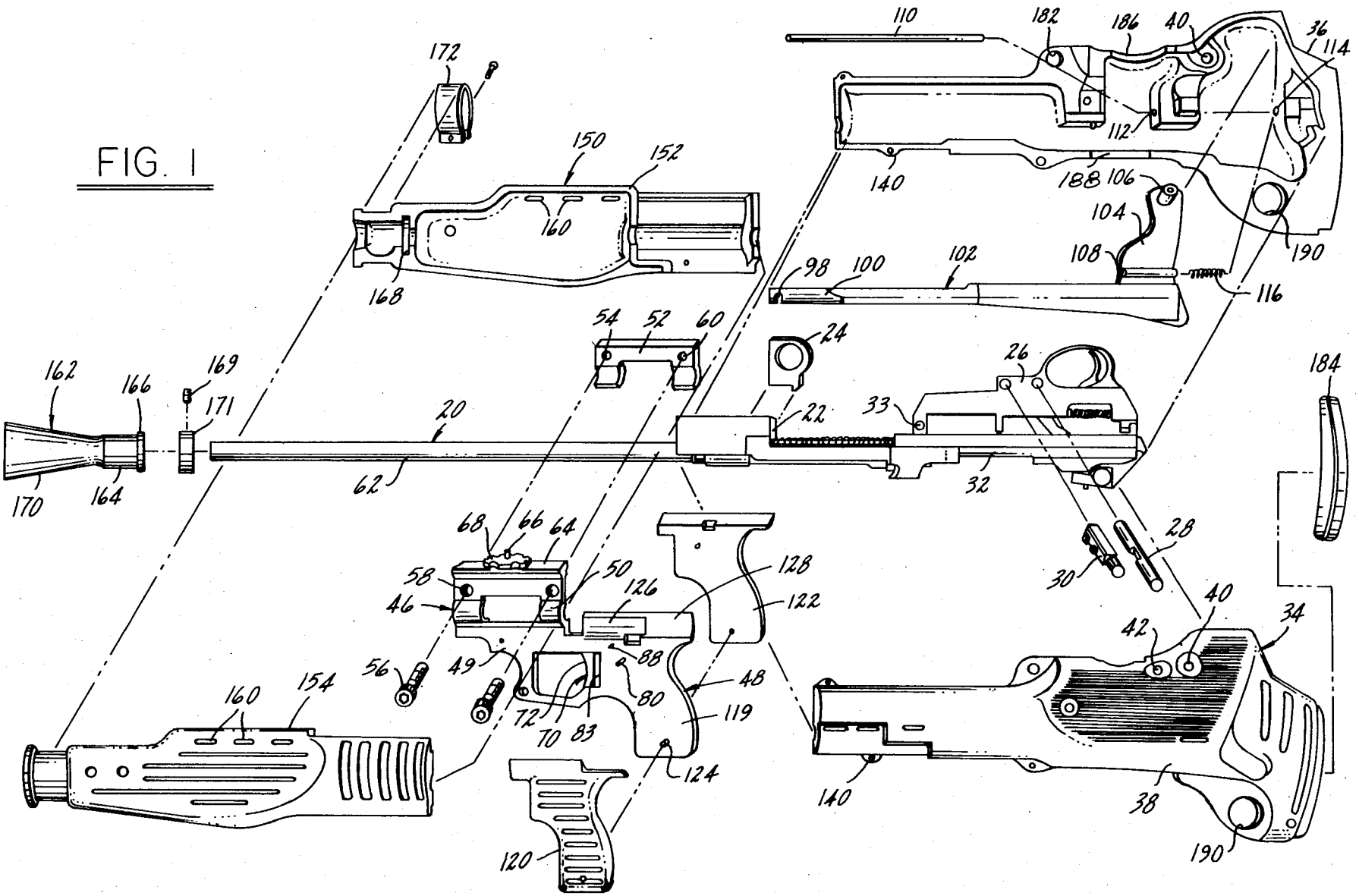
FIG. 1 is an exploded perspective view of a carbine which includes a presently preferred embodiment of the stock assembly in accordance with the present invention.

A second tab or dog 96 (FIGS. 8, 9 and 12) projects upwardly from follower 84 into and through an opening 98 in an arcuate trigger slide plate 100. Plate 100 is an integral part of a trigger slide 102 which extends from plate 100 along the inside wall of right-hand buttstock half-section 36 (FIGS. 4 and 15) generally parallel to the barrel axis to adjacent the rearward end of buttstock section 34. An arm 104 (FIGS. 1, 3, 4 and 15) extends upwardly from slide 102 along the inside wall surface of the buttstock half-section. A resilient button 106 is affixed to the free end of arm 104 and projects laterally therefrom into the trigger mechanism 26 of barrel and action assembly 20. Thus, slide 102 functions to couple trigger 70 of trigger housing assembly 46 to trigger mechanism 26 captured within and enclosed by buttstock section 34. A cylindrical collar 108 (FIGS. 1, 4 and 15) is affixed to the inwardly facing surface of arm 104 above slide 102 and is slidable in a direction parallel to the barrel axis on a guide rod 110. Guide rod 110 is supported at opposed ends within the apertures 112,114 (FIGS. 1, 4 and 14) in bosses which inwardly project from right-hand buttstock section 36 forwardly and rearwardly of trigger mechanism 26 (FIG. 4) and carries a coil spring 116 (FIGS. 1 and 4). Coil spring 116 is captured in compression on rod 110 between collar 108 and the shoulder or embossment surrounding rearward aperture 114 for normally biasing trigger slide 102 to the forward or non-firing position illustrated in the drawings. Thus, squeezing of trigger 70 against the force of springs 82,116 functions through follower 84, slide 102, arm 104 and button 106 to squeeze trigger mechanism 26 against the buttstock support, and thus to fire the rifle.

Trigger housing plate 49 integrally projects downwardly from trigger 70 in the configuration of a pistol grip 119. A pair of pistol grip sections 120,122 are received by press-fit over the pins 124,80 (FIGS. 1 and 9–11) on trigger housing plate 49 and are thereby fastened to the trigger housing. Note that the pin 80 thereby functions both to mount the contoured grip sections 120,122 and to bias trigger 70 forwardly in cooperative combination with spring 82 (FIGS. 8 and 11) as previously described. Right-hand grip section 122 captures trigger shank 74 laterally within pocket 76 and spring 82 within trigger slot 78. A pair of part-cylindrical wings 126,128 integrally project upwardly from the pistol grip portion 119 adjacent to the rearward edge of trigger housing plate 49 coaxially with barrel clamping bridges 50. In assembly, as best seen in FIGS. 9 and 10, trigger housing wings 126,128 embrace a corresponding pair of part-cylindrical walls 130,132 on the respective buttstock sections 38,36. Walls 130,132 terminate in a pair of downwardly facing shoulders 134,136. A lateral slot 138 (FIGS. 8 and 10–11) in trigger housing plate 49 between wings 126,128 receives the notch 140 which depends from and is formed by the respective buttstock half-sections 36,38. It will also be noted with particular reference to FIGS. 9 and 12 that the aperture 98 in arcuate slide plate 100 is likewise arcuate and includes a forwardly oriented opening 142 (FIG. 12). Thus, buttstock section 34, including barrel and action assembly 20 embraced thereby and trigger slide 102 captured therein, are free to rotate with respect to trigger housing 48 about the axis of barrel 62, which is rotatably embraced by the trigger housing as previously described. Preferably, such rotation is accommodated in equal opposite angular directions, illustrated in solid and phantom in FIG. 10, from the nominal position illustrated in the remaining figures wherein the trigger mechanism 26 of the barrel and action assembly and trigger 70 within the trigger housing are nominally coplanar. Rotation of the buttstock in opposite angular directions is limited by abutment of buttstock shoulders 134,136 with the opposing edges of trigger housing wings 126,128.

Figure 7:
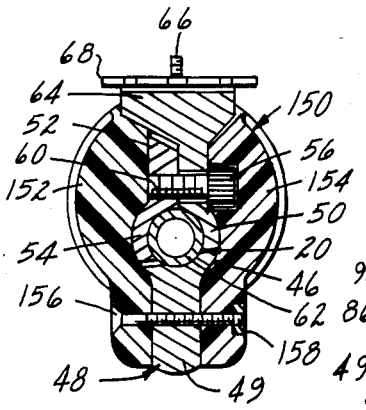

A forehand stock 150 is formed by a pair of concave forehand stock half-sections 152,154. The rearward portions of stock half-sections 152,154 are internally contoured, as best seen in FIG. 7, to be snugly received over the barrel-clamping section of trigger housing 48 and to be fastened thereto by the screw 156 (FIG. 7). Screw 156 extends through half-sections 152,154 and through trigger housing 48 into the threaded nut 158 molded into half-sections 154. The mid-portions of forehand stock half-sections 152,154 are contoured, as best seen in FIG. 6, to form an air chamber 159 surrounding barrel 62 of barrel and action assembly 20 extending therethrough. Apertures 160 are formed in the walls of the opposing stock half-sections 152,154 for admission of cooling air. A ring 171 is telescopically received over barrel 62 and is clamped thereto by the setscrew 169 in facing abutment with the rear portions of forehand stock half-sections 152,154, as best seen in FIG. 3. During rotation of buttstock 34 in opposite angular directions, axial positioning of the trigger housing with respect to the barrel is maintained by ring 171 and setscrew 169.

A conical flash hider 162 (FIGS. 1–3 and 5) includes a cylindrical collar 164 having an outwardly projecting flange 166 at its rearward end captured within a circular notch 168 formed by the opposing forward ends of forehand stock half-sections 152,154. A conical body 170 is affixed to and opens forwardly of collar 164 surrounding the free end of barrel 62 (FIG. 3). A clamp ring 172 embraces the forward ends of forehand stock half-sections 152,154 so as to capture flash hider 162 therebetween. Preferably, as best seen in FIGS. 3 and 5, forehand stock half-sections 152,154, and collar 164 of flash hider 162 captured thereby, are radially spaced from barrel 62, which is to say that barrel 62 is free-floating within the flash hider and forehand stock. This not only provides for free rotation of the barrel and action assembly and buttstock 34 with respect to trigger housing assembly 46 and forehand stock 150 affixed thereto by screw 156, but also provides for enhanced cooling of barrel 62 during operation. More particularly with respect to the latter feature, the force of combustion gases exiting the free end of barrel 62 during firing cooperates with the geometry of conical body 170 to draw cooling air by a venturi-type action through apertures 160 into and through forehand stock cavity 159 surrounding barrel 62 and through the passage 180 (FIG. 5) between collar 164 and barrel 62.

Operating slide handle 24 is apertured so as to cooperate with a pair of apertures 182 (FIGS. 1, 3 and 4) in buttstock section 34 on either side of the rearward end of slot 44 for locking handle 24 in the rearward position for maintenance or cleaning of the action. A padded shoulder-abutment cap 184 is received and held by snap-fit or by screws (not shown) over the convex rearward end of buttstock 34 to hold the buttstock sections together. It will be noted in the drawings that the barrel and action assembly 20 is assembled into buttstock section 34 in upside-down orientation, with the trigger mechanism 26 projecting upwardly. Thus, the opposing edges of buttstock half-sections 36,38 are contoured to form an upwardly opening magazine aperture 186 (FIGS. 2–4) and a downwardly opening shell ejection aperture 188 (FIGS. 3–4). Front clamp 172 (FIGS. 1–3 and 5) may be replaced by a clamp having a ring depending therefrom, which may cooperate with an aperture 190 (FIGS. 1, 3 and 4) at the lower rearward end of buttstock section 34 for attachment of a shoulder strap or the like.

Thus, in accordance with a first feature of the disclosure, an improved stock assembly is provided for use in conjunction with a barrel and action assembly of generic configuration, preferably a U.S. M1 carbine, to form a new and improved rifle or carbine. The stock sections are configured so as to place the action of the barrel and action assembly adjacent to the rearward or shoulder-abutment end of the buttstock section, thereby yielding an overall shorter rifle while maintaining original actual barrel length. In the presently preferred implementation of the invention, it is contemplated that the improved rifle stock will be provided in the form of a kit for assembly to a pre-existing barrel and action assembly by the user. Such kit would include the four stock half-sections 36, 38, 152, 154, flash hider 162, clamp 172, handle 24, releases 28,30, bar 52, cup 184 and grip section 120, together with mounting screws, etc. Slide 102, bar 110 and spring 116 may be preassembled to buttstock half-section 36. The trigger housing would be provided as a sub-assembly in the form illustrated in FIG. 1 with grip section 122 affixed thereto to capture the trigger therein, as described. Preferably, all stock and hand grip sections are of light-weight impact-resistant molded plastic construction for reducing weight of the overall assembly. The resulting assembly is not only easier to carry than was the original carbine, but also possesses a distinctive and pleasing appearance.

In accordance with another feature of the disclosure, the buttstock section is rotatable about the axis of the barrel with respect to the trigger housing and forehand stock sections. This is particularly advantageous where the magazine projects upwardly from the buttstock since sighting down the forehand stock and barrel is greatly facilitated. Moreover, the ability to rotate the buttstock in either direction, particularly combined with the upward rather than lateral projection of operating slide handle 24, makes the overall carbine assembly more comfortable to use for either left-handed or right-handed operators. The carbine and improved stock assembly of the disclosure provides enhanced cooling of the barrel by circulation of cooling air thereabout by a venturi-type action through the flash hider, while providing a gripping surface and protecting the user against direct contact with the barrel during operation. As previously noted, the scope mounting platform 64 is accurately positioned with respect to the axis of the barrel 62. The improved stock assembly includes a minimum number of moving parts, and may be readily disassembled for maintenance or repair.

The invention claimed is:

1. A rifle with improved stock assembly comprising: a barrel and action assembly including receiver and trigger mechanisms having a barrel projecting therefrom; separate hollow butt and forehand stock sections enclosing said barrel and action assembly, said receiver and trigger mechanisms being enclosed within said buttstock section and said barrel projecting therefrom through said forehand section; a trigger assembly projecting from said forehand stock section and including trigger means for actuation by an operator; and means slidable within said buttstock section coupling said trigger means to said trigger mechanism for firing said barrel and action assembly when said trigger means is actuated by an operator; said buttstock section including means at one external end for abutting an operator's shoulder, and means internally of said buttstock section for locating said receiver and trigger mechanisms internally adjacent to said shoulder-abutting means in inverted orientation, such that said trigger mechanism and said trigger means project generally oppositely of the axis of said barrel and action assembly.

2. The rifle set forth in claim 1 further comprising means mounting said buttstock section onto said forehand stock section for rotation of said buttstock section with respect to said forehand stock section about said axis.

3. The rifle set forth in claim 4 further comprising means on said forehand and buttstock sections for limiting rotation of said buttstock section equally in both directions about said axis from an orientation wherein said trigger means and said trigger mechanism are coplanar.

4. The rifle set forth in claim 1 wherein said trigger assembly comprises means within said forehand stock section for clamping engagement with said barrel, and a trigger housing affixed to said clamping means and projecting from said forehand stock section, said trigger means being carried by said trigger housing for sliding motion parallel to said axis.

5. The rifle set forth in claim 4 wherein said trigger assembly further comprises pistol grip means adjacent to and projecting from said trigger housing.

6. The rifle set forth in claim 4 wherein said trigger means comprises a trigger, guide means for guiding sliding motion of said trigger with respect to said trigger housing, a first spring biasing said trigger forwardly of said housing, and follower means coupled to said trigger and carried by said housing for sliding motion conjointly with said trigger, said means slidable within said buttstock section being coupled to said follower means.

7. The rifle set forth in claim 6 wherein said means slidable within said buttstock section comprises a slide coupled at a forward end to said follower means and extending within said buttstock section parallel to said axis, an arm projecting radially from said slide at the rearward end thereof within said buttstock section adjacent to said shoulder-abutting means, and means on an end of said arm remote from said slide projecting perpendicularly of said axis into said trigger mechanism.

8. The rifle set forth in claim 7 further comprising means within said buttstock section adjacent to said shoulder-abutting means for supporting and guiding motion of said slide parallel to said axis, and a second spring for urging said slide forwardly with respect to said supporting and guiding means.

9. The rifle set forth in claim 7 further comprising means mounting said buttstock section onto said forehand stock section for rotation of said buttstock section with respect to said forehand stock section about said axis.

10. The rifle set forth in claim 9 wherein said slide includes an arcuate plate having a slot concentric with said axis, said follower means including means projecting into said slot such that said follower means remains coupled to said slide within said slot during rotation of said buttstock section and slide about said axis.

11. The rifle set forth in claim 4 wherein said trigger assembly further comprises means for mounting an optical scope sight to said rifle, said scope-mounting means being rigidly affixed to said barrel-clamping means so as to fixedly orient said scope-mounting means with respect to the said axis of the barrel clamped by said barrel-clamping means.

12. The rifle set forth in claim 1 wherein said forehand stock section includes means forming an air cavity surrounding said barrel and apertures for admitting air into said cavity.

13. The rifle set forth in claim 12 further comprising a funnel-shaped flash hider projecting from said forehand stock section surrounding the end of said barrel remote from said buttstock section.

14. The rifle set forth in claim 13 wherein said forehand stock section and said flash hider are spaced radially of said barrel, such that air is drawn by venturi forces into said forehand stock section through said apertures by propulsion of gasses exiting said barrel.

15. An improved stock assembly kit for the barrel and action assembly of a U.S. M1 carbine which includes trigger, receiver and operating slide mechanisms having a barrel projecting therefrom, said kit comprising:

a hollow buttstock section including opposed concave half-sections internally contoured to receive the action portion of said barrel and action assembly, including said trigger, receiver and operating slide mechanisms, a trigger assembly constructed to be mounted to the barrel of said barrel and action assembly adjcent to the forward end of said buttstock section externally of said buttstock section, said trigger assembly including a trigger housing and a trigger mounted for sliding motion in said trigger housing, said buttstock section including means at one external end for abutting an operator's shoulder, and means internally of said buttstock section for locating said receiver and trigger mechanisms internally adjacent to said shoulder-abutting means in inverted orientation, such that said trigger mechanism and said trigger means project generally oppositely of the axis of said barrel and action assembly, a trigger slide constructed to be carried within said buttstock section for slidably coupling said trigger to a said trigger mechanism, and a hollow forehand stock section including opposed concave half-sections contoured to be affixed to said trigger assembly and projecting forwardly therefrom so as to enclose the barrel of a said barrel and action assembly.

16. The carbine stock kit set forth in claim 15 further comprising means for mounting said buttstock section onto said trigger assembly and said forehand stock section for rotation of said buttstock section and said rifle and action assembly with respect to said trigger assembly and said forehand stock section about said axis.

17. The carbine stock kit set forth in claim 16 further comprising first means on said trigger assembly and said forehand stock section and second means on said buttstock section for limiting rotation of said buttstock section equally in both directions about said axis from an orientation wherein said trigger means and said trigger mechanism are coplanar.

18. The carbine stock kit set forth in claim 17 wherein said trigger assembly further comprises pistol grip means adjacent to and projecting from said trigger housing.

19. The carbine stock kit set forth in claim 16 wherein said trigger assembly further comprises means for clamping engagement with said barrel and means for mounting an optical scope sight to said carbine, said scope-mounting means being rigidly affixed to said barrel-clamping means so as to fixedly orient said scope-mounting means with respect to the axis of the barrel clamped by said barrel-clamping means.

20. The carbine stock kit set forth in claim 16 wherein said forehand stock section includes means for forming an air cavity surrounding said barrel and apertures for admitting air internally of said cavity.

21. The carbine stock kit set forth in claim 20 further comprising a funnel-shaped flash hider for projecting from said forehand stock section to surround the end of said barrel remote from said receiver and trigger mechanism.

22. The carbine stock kit set forth in claim 21 wherein said forehand stock section cavity and said flash hider are spaced radially from said barrel, such that air is drawn by venturi forces into said cavity through said apertures by propulsion of gasses exiting said barrel.

* * * * *